US005513608A

United States Patent [19]

Takashima et al.

[11] Patent Number: 5,513,608

[45] Date of Patent: May 7, 1996

[54] TWO CYCLE ENGINE LUBRICATING SYSTEM

[75] Inventors: Kazutoshi Takashima; Tomohiro Kanamaru, both of Hamamatsu, Japan

[73] Assignee: Sanshin Kogyo Kabushiki Kaisha, Hamamatsu, Japan

[21] Appl. No.: 112,442

[22] Filed: Aug. 26, 1993

[30] Foreign Application Priority Data

Aug. 26, 1992 [JP] Japan ..... 4-250651
Aug. 26, 1992 [JP] Japan ..... 4-250652

[51] Int. Cl.[6] ..... F01L 3/00

[52] U.S. Cl. ..... 123/196 W; 123/196 CP

[58] Field of Search ..... 123/73 AD, 196 R, 123/196 CP, 196 W, 193.2, 193.4, 193.6; 92/158, 159, 160

[56] References Cited

U.S. PATENT DOCUMENTS

| | | | |
|---|---|---|---|
| 3,911,870 | 10/1975 | Hackbarth | 123/196 W |
| 4,121,551 | 10/1978 | Turner | 123/196 CP |
| 4,261,305 | 4/1981 | Ikoma | 123/196 R |
| 4,599,979 | 7/1986 | Breckenfeld et al. | 123/73 AD |
| 4,831,979 | 5/1989 | DuBois et al. | 123/196 R |
| 5,052,355 | 10/1991 | Ito et al. | 123/73 AD |
| 5,190,121 | 3/1993 | Mozyka | 123/196 R |
| 5,201,805 | 4/1993 | Schubert | 123/196 M |
| 5,375,573 | 12/1994 | Bowman | 123/73 AD |

FOREIGN PATENT DOCUMENTS

| | | | |
|---|---|---|---|
| 2756424 | 6/1979 | Germany | 92/160 |
| 54-65229 | 5/1979 | Japan . | |
| 61-12636 | 6/1986 | Japan . | |
| 0087035 | 8/1936 | Sweden | 123/196 W |

*Primary Examiner*—Erick R. Solis
*Attorney, Agent, or Firm*—Knobbe, Martens, Olson & Bear

[57] ABSTRACT

A lubricating system for a reciprocating machine such as a two cycle internal combustion engine having the cylinder bores horizontally disposed. A drain system is provided for draining lubricant from the lowermost crankcase chambers to the upper cylinders so as to maintain uniformity of lubrication and insure even and smooth running. A check valve is provided for precluding reverse flow and the lubricant is delivered both to the crankcase chambers and to the piston through either the piston and/or cylinder liner. The lubricant supplied to the piston is supplied at its upper area so as to insure complete lubrication of its circumference and of the associated cylinder bore.

32 Claims, 7 Drawing Sheets

TWO CYCLE ENGINE LUBRICATING SYSTEM

BACKGROUND OF THE INVENTION

This invention relates to a two cycle engine lubricating system and more particularly to an improved lubricating system for reciprocating machines.

As is well known, two cycle combustion internal engines are normally lubricated by supplying minute quantities of lubricant to the engine through its induction and porting system for lubricating the various moving components of the engine. This type of lubricating system has the advantage of extreme simplicity. However, it is extremely important that the amount of lubricant supplied to the engine be accurately controlled so as to insure adequate lubrication without excess lubricant being contain in the exhaust gases of the engine.

The lubricant for two cycle engines is supplied in a wide variety of manners. For example, lubricant may be mixed with the fuel which is consumed by the engine, lubricant may be sprayed into the induction system of the engine, and/or lubricant may be delivered directly to certain components of the engine for their lubrication. Obviously, combinations of the above system may be employed. Regardless of how the lubricant is supplied, however, it is desirable to ensure that lubricant can not collect in any portion of the engine due to condensation. If this occurs, the condensed lubricant can periodically flow into the engine along with the fuel and cause irregular combustion or other problems.

It has been proposed, therefor, to provide some arrangement which will insure that lubricant can not collect in lower portions of the engine. For example, systems have been proposed for providing a drain passage that extends from the lower portion of the crankcase chamber back to the induction system so that the air flowing to the engine through the induction system will draw the condensed lubricant and/or fuel back into the induction system for redistribution.

The previously proposed systems have, however, provided a number of difficulties. For example, in outboard motor applications the engine is normally positioned with its crankshaft rotating about a vertically extending axis and the cylinder bores extending horizontally. As is typical with two cycle engines, each crankcase chamber is sealed from the other. However, these seals inherently permit some leakage from the upper most cylinders to the lowermost cylinders. When this occurs, even if conventional type of recirculating or drain systems are employed, the lowermost cylinders will tend to receive more fuel and lubricant than the uppermost cylinders. This can cause inadequate lubrication and, furthermore, can cause excess of smoke in the exhaust and poor running.

It is, therefor, a principle object of this invention to provide an improved lubricating system for a two cycle engine.

It is a further object of this invention to provide an improved lubricating system for a two cycle engine wherein the engine is disposed with its cylinders horizontally oriented.

It is a further object of this invention to provide an improved lubricating system for a horizontally disposed two cycle multiple cylinder engine that will balance the lubrication for the individual cylinders.

Various arrangements have been provided in horizontally disposed engines so as to introduce lubricant to the area of the cylinder bore that is swept by the piston for lubricating the sliding surfaces. Generally, however, this is done by introducing the lubricant at a low area in the cylinder. As a result, the lubricant does not have an opportunity to flow completely around the cylinder bore and only the lowermost portion receives adequate lubrication, It is, therefor, a still further object of this invention to provide an improved lubricating structure for the cylinders and pistons of a horizontally disposed engine.

It is a further object of this invention to provide an improved lubricating system that will insure that substantially the entire cylinder bore circumference and piston circumference are lubricated.

Although the use passages in the cylinder itself for introducing lubricant to the cylinder bore are advantageous, this requires casting or machining techniques which may be difficult, particularly with multiple cylinder engines.

It is, therefor, a still further object of this invention to provide an improved cylinder bore lubricating structure wherein the lubricant is delivered to the cylinder bore through the piston rather than through the cylinder.

SUMMARY OF THE INVENTION

A first feature of this invention is adapted to be embodied in a lubricating system for an internal combustion engine having at least two lubricated portions one disposed vertically higher than the other. Means are provided for draining lubricant from a lower area of the lower of the lubricated portions and delivering the drained lubricant to an upper area of the upper lubricated portion.

Another feature of the invention is adapted to be embodied in a two cycle internal combustion engine having a cylinder with a horizontally extending cylinder bore. A piston is reciprocal in the cylinder bore and sweeps a portions of the length of the cylinder bore during its reciprocation. Means are provided for introducing lubricant into the sept area of the cylinder bore at a point above the lower periphery of the cylinder bore.

Another feature of the invention is also adapted to be embodied in a two cycle internal combustion engine having a cylinder that defines a cylinder bore and a piston which reciprocates in the cylinder bore. In accordance with this feature of the invention, means are provided for forming a lubricant passage from the interior of the piston to its external surface for delivering lubricant to the cylinder bore and outer surface area of the piston.

DETAILED DESCRIPTION OF THE PREFERRED EMBODIMENTS OF THE INVENTION

Figure 1:
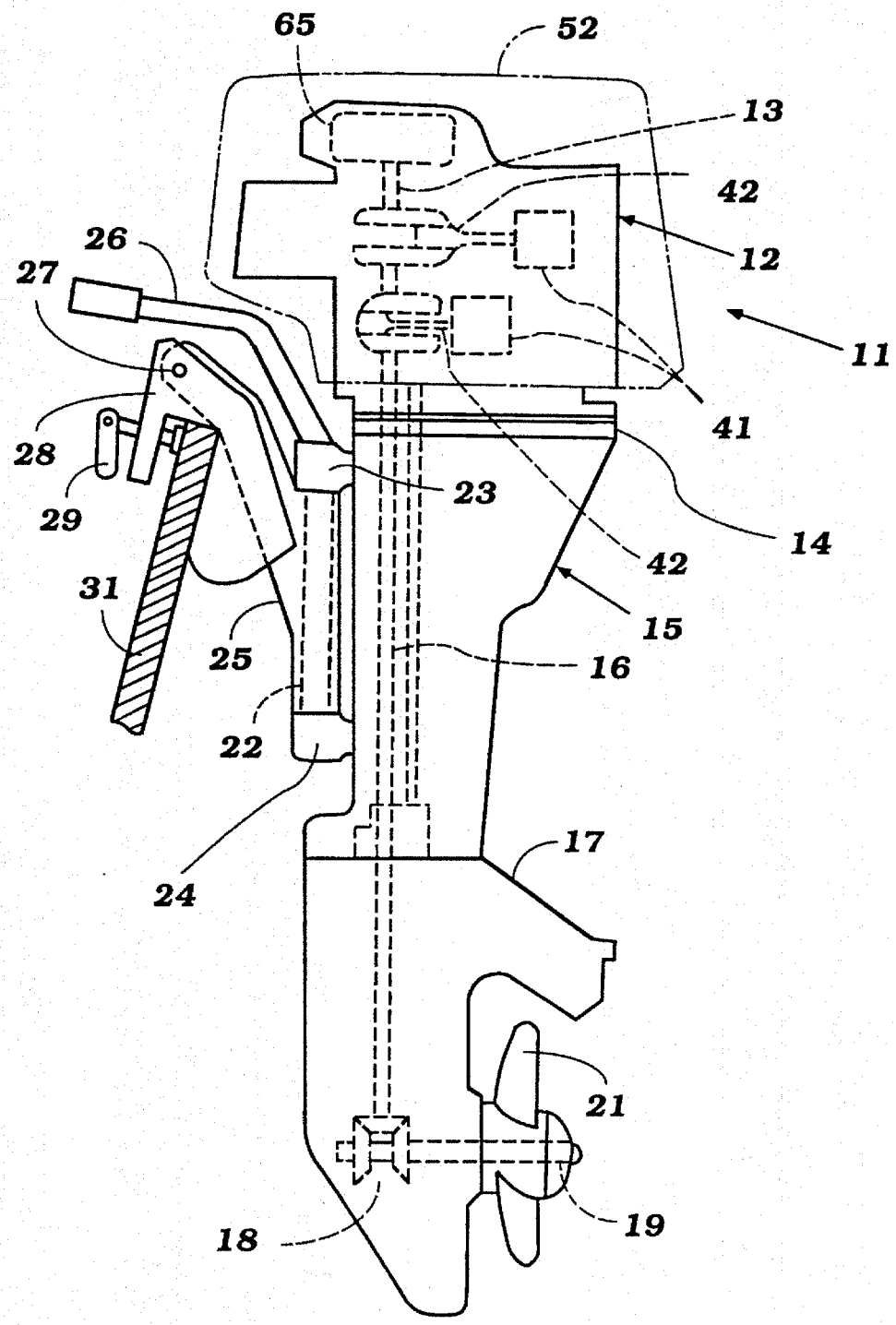
FIG. 1 is a side elevational view of an outboard motor constructed in accordance with an embodiment of the invention, shown as attached to the transom of a watercraft, shown partially and in cross-section.

Referring now in detail to the drawings and initially to FIG. 1, an outboard motor constructed in accordance with an embodiment of the invention is identified generally by the reference numeral 11. The invention is described in conjunction with an outboard motor for explanation of an environment in which the invention may be employed. This environment is depicted and will be described because it is a typical environment in which two cycle internal combustion engines are employed and also a typical environment wherein such engines are disposed with their output shafts rotating about vertically disposed axes. These two features are important in the invention, although it is to be understood that the invention may be employed with engines having other orientations and other applications.

The outboard motor 11 is comprised of a powerhead consisting of an internal combustion engine, indicated generally by the reference numeral 12 which in the illustrated embodiments is of the V-4 type operating on a two stroke crankcase compression principle. Although the invention may be employed in conjunction with operating on other cycles it will be readily apparent to those skilled in the art that it has particular utility with two stroke engines because of the manners in which they are normally lubricated. Also, the actual number of cylinders employed and the cylinder configuration may vary and some facets of the invention also may be employed with single cylinder engines.

The engine 12, as is typical with outboard motor practice is supported so that its cylinder bores (to be described) extend horizontally and its crankshaft 13 rotates about a vertically extending axis.

The powerhead as thus far described is supported on a mounting plate 14 and is attached to the upper end of a drive shaft housing assembly 15. A drive shaft 16 is rotatably journalled in the drive shaft housing assembly 15 and is coupled to the engine crankshaft 13 so as to be driven thereby. The drive shaft 16 further depends into a lower unit 17 where it drives a conventional type of forward, neutral, reverse transmission 18 for driving a propeller shaft 19 and attached propeller 21 in selected forward or reverse directions.

A steering shaft 22 is affixed to the drive shaft housing 15 by upper and lower brackets 23 and 24, respectively. The steering shaft 22 is journalled for rotation about a generally vertically extending steering axis in a swivel bracket 25. A tiller 26 is affixed to the upper end of the steering shaft 22 for effecting this steering.

The swivel bracket 25 is pivotally connected by means of a pivot pin 27 to a clamping bracket 28 for tilt and trim movement of the outboard motor 11 as is well known in this art. The clamping bracket 28 carries a clamping device 29 for providing a detachable connection of the outboard motor 11 to a transom 31 of an associated watercraft.

As has been noted, the foregoing description of the outboard motor 11 is primarily so as to orient an application in which the invention may be employed. The invention deals primarily with the lubrication system of the engine 12 and a first embodiment of this lubrication system will be described by reference to FIGS. 2 and 3 in addition to FIG. 1.

Figure 2:
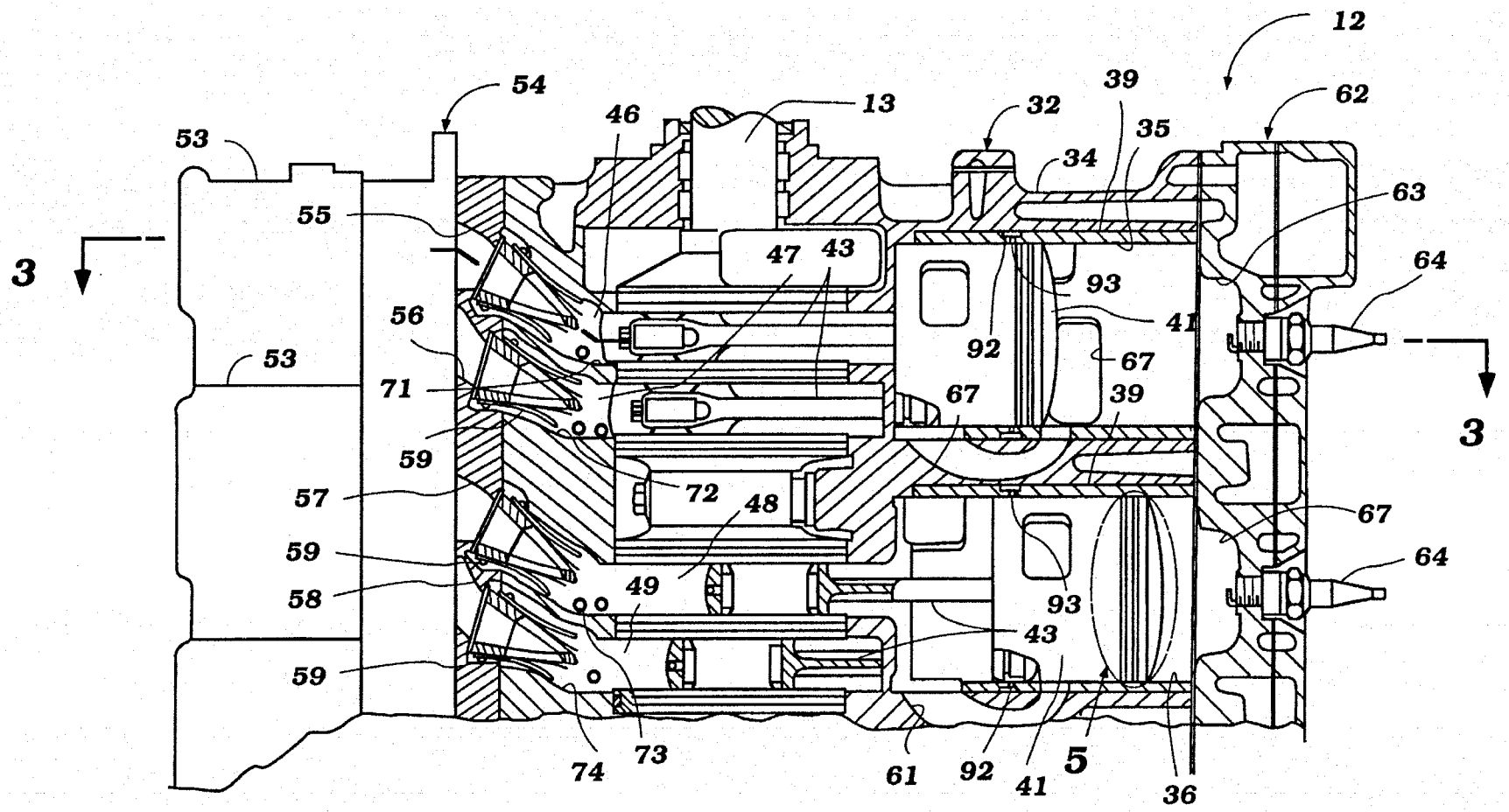
FIG. 2 is an enlarged cross-sectional view taken through the cylinders of one cylinder bank of the engine.

As has been already noted, the engine 12 is, in the illustrated embodiment, of the V-4 type and includes a cylinder block, indicated generally by the reference numeral 32 having a pair of angularly related cylinder banks 33 and 34 each of which is formed with a pair of cylinder bores. These cylinder bores include the cylinder bores 35 and 36 of the cylinder bank 34 which are shown in FIG. 2 and a pair of cylinder bores 37 and 38 only one of which (37) appears in FIG. 3. The remaining cylinder bore is depicted schematically in FIG. 8. Each of the cylinder bores 35, 36, 37 and 38 is formed by a respective cylinder liner 39 which is cast or pressed into the cylinder block 32 in a well known manner.

Pistons 41 are supported for reciprocation in the respective cylinder bores 35, 36, 37, and 38. The pistons 41 are connected by means of piston pins 42 to the small ends of connecting rods 43. The big ends of the connecting rods 43 are journalled on respective throws 44 of the crankshaft 13 in a well know manner. The crankshaft 13 is rotatably journalled in a crankcase assembly formed by the cylinder block 32 and a crankcase member which may be affixed to it in any known manner. As is typical with two cycle practice, the crankcase in which the crankshaft 13 rotates is divided into a plurality of separate sealed chambers 46, 47, 48 and 49 that are associated with the cylinder bores 35, 36, 37 and 38, respectively.

An air charge is supplied to these individual crankcase chambers 46, 47, 48, and 49 by an induction system that includes an air inlet device 51 which draws atmospheric air from the area in the protective cowling and circled by an outer cowling assembly 52 shown in phantom in FIG. 1 which encircles the engine 12. As is well known in this art, the cowling assembly 52 is provided with an atmospheric air inlet so that atmospheric air may be drawn into the cavity and into the air inlet device 51.

Any type of charge forming system may be provided for the engine 12 and in the illustrated embodiments, this charge forming system is comprised of a plurality of carburetors 53 which receive the air charge from the air inlet device 51 and mix fuel with it for delivery to a combined intake manifold, valve assembly, indicated generally by the reference numeral 54. This assembly includes a plurality of induction passages 55, 56, 57 and 58 which each deliver the air fuel charge to the respective crankcase chambers 46, 47, 48 and 49. Reed type valve assemblies 59 are provided in each of the intake passages or runners 55, 56, 57 and 58 so as to permit the air fuel charge to be drawn into the crankcase chambers 46, 47, 48 and 49 but which preclude reverse flow when the charge is being compressed by the decent of the pistons 41 in their respective cylinder bores.

The intake charge which has been drawn into the crankcase chambers 46, 47, 48 and 49 and compressed therein is then transferred to combustion chambers, formed in a manner to be described, by respective scavenge passages shown partially in FIG. 2 and identified generally by the reference numeral 61. Any desirable or known type of scavenging system may be provided for this purpose.

The combustion chambers are formed by the respective cylinder bores 35, 36, 37 and 38, the pistons 41 and cylinder head assemblies, indicated generally by the reference numeral 62 and which are affixed to the respective cylinder banks 33 and 34 in any well known manner. The cylinder head assemblies 62 have recesses 63 which form the primary volume of the combustion chamber when the pistons 41 are at top dead center position.

The charge which is thus further compressed in the combustion chambers is then fired by sparks plugs 64 that are mounted in the cylinder head 62 with their spark gaps extending into the combustion chamber recesses 63. The spark plugs 64 are fired by means of an ignition system including a flywheel magneto 65 (FIG. 1) that is driven from the upper end of the crankshaft 13 in a well known manner.

It should be noted that the charged forming system for the engine described is of the type that employs carburetors. It is understood that the invention may be equally as well practiced with engine employing fuel injection that injects fuel either into the intake passages 55, 56, 57 and 58, into the crankcase chambers 46, 47, 48 and 49, into the scavenge passages 61 and/or directly into the combustion chamber recesses 63. Any of the known types of fuel injection systems may be employed without departing from the invention.

The charge which has been ignited by the spark plugs 64 will burn and expand and drive the pistons 41 downwardly to drive the crankshaft 13 in a well known manner. The burnt charge is then exhausted into a pair of exhaust manifolds 66 formed at least in part by the cylinder block 32 in the valley formed between the cylinder banks 33 and 34 through exhaust ports 67 formed in the cylinder liners 35. As is typical with two cycle outboard motor practice, the exhaust manifold 66 deliver the exhaust gases downwardly to a silencing and discharge system provided in the drive shaft housing 15 and lower unit 17 and which may be of any known type.

The construction of the engine 12 as thud far described may be considered to be conventional and, has been noted, the invention deals with the lubrication system for the engine. This system will now be described by particular reference to FIGS. 4–8 of this embodiment.

Lubricant is supplied to the engine 12 for its lubrication by any conventional type of lubricant supply system and this may include the mixing of fuel and lubricant before or at the delivery point with the carburetors 53 or by systems that employ a spray type of lubricating system which spray lubricant into the intake passages 55, 56, 57 and 58. As will later be described, the invention may also be employed in conjunction with lubricating systems wherein at least a portion of the lubricant is delivered under pressure from a lubricant tank to various components of the engine which are to be lubricated. Except for the system that will be described by reference to FIG. 9, the way in which the lubricant is initially supplied to the engine for its lubrication is not a part of the invention. However, the way in which condensed lubricant is collected and employed to lubricate other portions of the engine is important and this will now be described by particular reference to FIGS. 2–4 and FIG. 8 with the latter figure being a schematic view showing how the lubricant that is collected from one cylinder is delivered to other cylinders.

Of course it is important that the main bearings for the crankshaft 13 be lubricated as well as the bearings between the connecting rods 43 and the crankshaft 13 and the connection between the connecting rods 43 and pistons 41 through the piston pins 42. Basically, the bulk of this lubricant will be delivered in some well known manner to the individual crankcase chambers 46, 47, 48 and 49 so as to lubricate these components. However and as is well known in two cycle engine practice, a portion of the lubricant and even a portion of the fuel which is supplied to the crankcase chambers 46, 47, 48 and 49 will condense and will collect at the lowest points in the crankcase chambers these lowest points being indicated by the reference numerals 71, 72, 73 and 74 respectively.

It should be noted also that, as is typical with V-type engine practice, the cylinders in the cylinder bank 34 are staggered relative to the cylinders in the cylinder bank 33 with the corresponding cylinders of the bank 34 being disposed vertically higher than those of the cylinder bank 33. In addition, although the crankcase chambers 46, 47, 48 and 49 are basically sealed from each other, condensed lubricant will tend to seep downwardly to the lowermost level. Hence, unless some adjustment or correction is made for this there will be more lubricant in the lowermost chamber portion 74 than that immediately above it (chamber 73) and so on. Hence, as in accordance with the invention there is provided a means for draining the lubricant from the lowermost chambers 47, 48 and 49 and delivering it to the chambers at a higher level.

Figure 8:
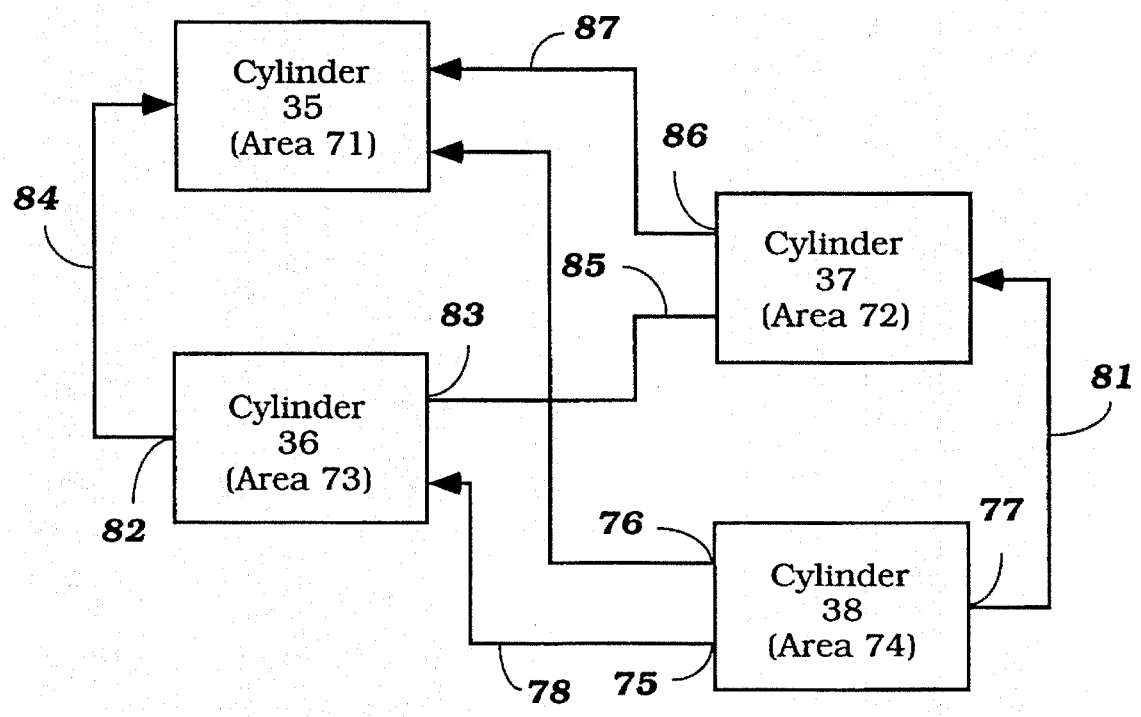
FIG. 8 is a schematic view that shows the relationship of the lubrication drains from the various cylinders of the engine.

In addition to this feature, it is also desirable to insure that the piston sliding surfaces are well lubricated and the lubricant drained from the individual crankcase chambers 46, 47, 48 and 49 is delivered not only to a higher area on the piston of the adjacent or respective cylinder bore 35, 36, 37 and 38 but also to the pistons of the uppermost cylinders. This arrangement may be best understood by reference to the aforenoted figures and FIG. 8 shows schematically how this draining and reconveyance system operates.

This system will be described by particular reference initially to FIG. 8 although the actual physical components employed may be seen in FIGS. 2–4. The lowermost crankcase chamber 49 is provided with three drain ports 75, 76 and 77 with the port 75 being connected to the cylinder 36 by a conduit, indicated generally by the reference numeral 78, the port 76 being connected to the cylinder 35 by a conduit 79 and the port 77 being connected to the cylinder 37 through a conduit 81. Hence, the lower cylinder 38 of the cylinder bank 33 is connected to the two cylinders of the opposite bank 35 and 36, both of which are higher and also to the cylinder 37 of the same bank which is obviously higher.

The next cylinder up from the bottom of the engine, the cylinder 36 has its chamber 48 and particularly the drain area 73 provided with two drain ports 82 and 83. The drain port 82 is connected to the upper most cylinder of this bank 35 by means of a conduit 84 while the port 83 is connected to the top cylinder 37 of the other bank 33 by means of a conduit 85. The next cylinder up in vertical position, cylinder 37, has its crankcase chamber 47 and specifically its lower drain area 72 provided with a single drain port 86 which is connected by means of a conduit 87 to the next higher cylinder 35. Hence, the lower drain areas 72, 73 and 74 of the lowermost three cylinders are all drained to the cylinders above them through the conduits as thus far described.

Figure 3:
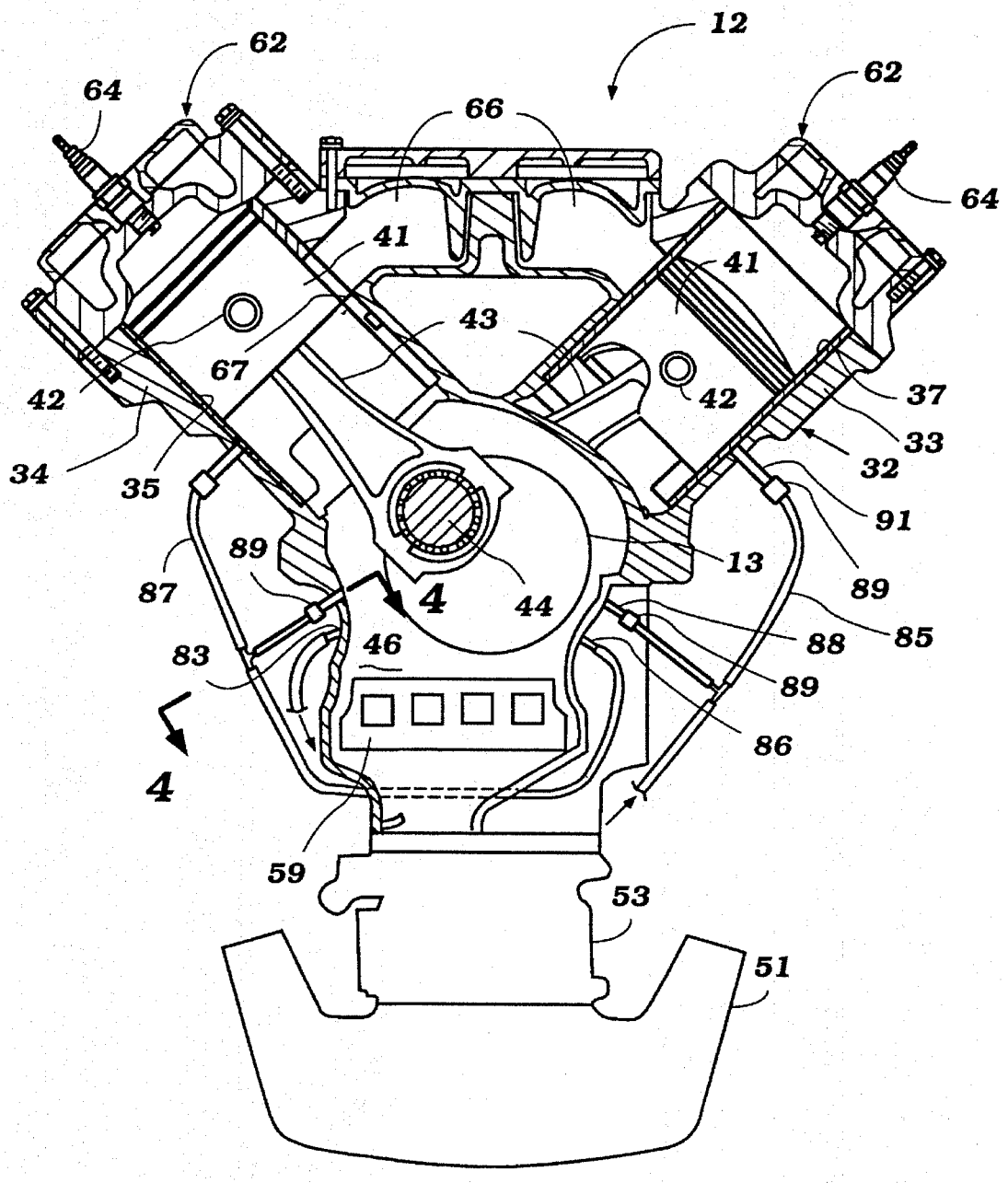
FIG. 3 is a reduced scale cross-sectional view taken along the line 3—3 of FIG. 2.
Figure 4:
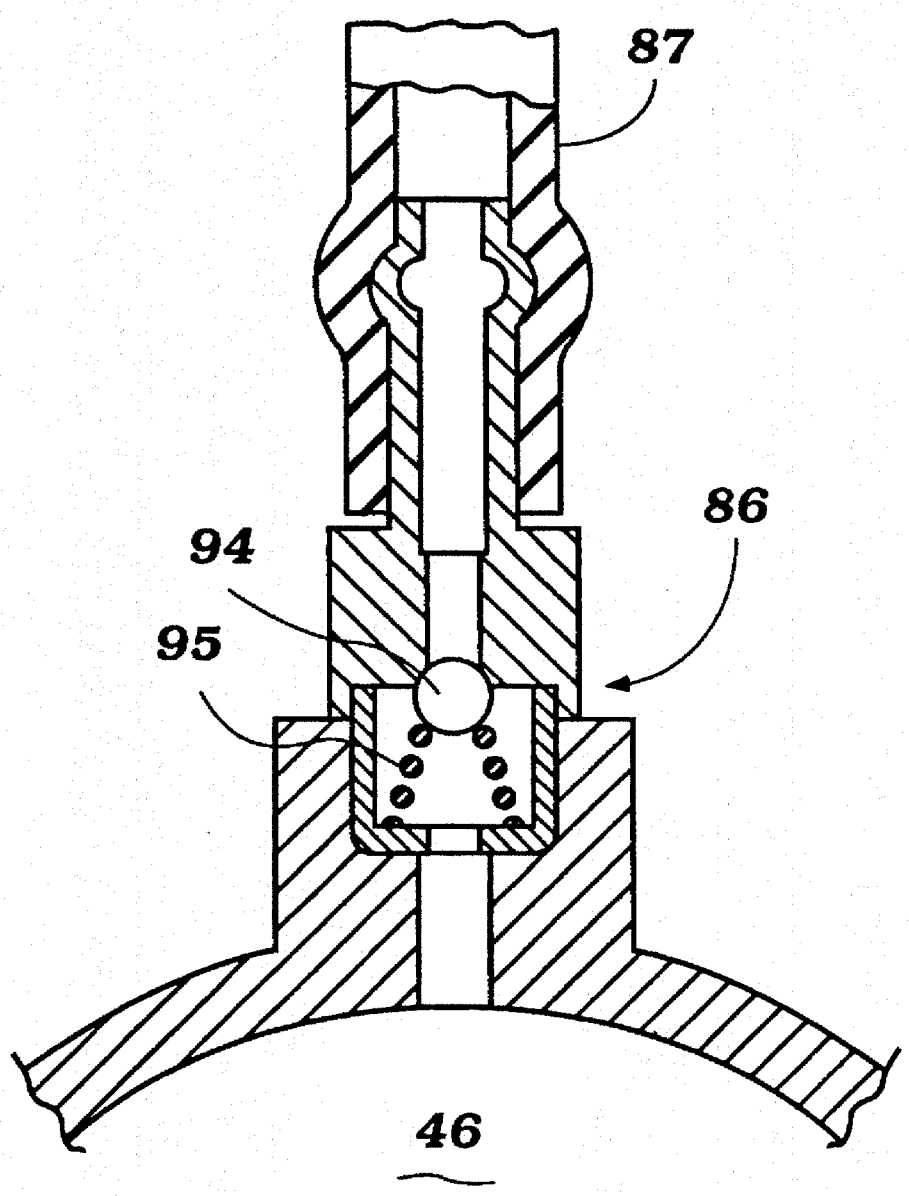
FIG. 4 is a cross-sectional view taken along the line 4—4 of FIG. 3 and is also typical of the check valve arrangement employed with the various lubricating passages.

Each of the conduits 78, 79, 81, 84, 85 and 87 terminates at two positions in the respective cylinders 35, 36 and 37 as may be best seen by FIG. 3 wherein the conduits 85 and 87 are shown. Each conduit has a first connection 88 in which a check valve assembly 89 is positioned to the respective crankcase chamber of the cylinder which it serves. This connection is well above the respective drain area. With respect to the conduit 85, this is the crankcase chamber 47 of the cylinder 37 which is above the respective drain area 72. The second conduit termination 91 is in registry with a circumferential groove 92 that encircles the respective cylinder bore and which is provided with one or more delivery ports that are disposed at a level that is positioned in the upper portion of the grooves 91 and which serves the cylinder bore by means of one or more small drilled passageways 92 that are positioned at the upper ends of the cylinder bores. Hence, the area of the cylinder bore swept by the pistons 41 will receive lubricant through the groove 91 and passage 92 so as to insure that the complete circumference of the piston is lubricated.

Check valves 89 are also provided in the conduits 91 for a reason which will now be described. As may be seen in FIG. 4, each of the check valves 89, this being the one associated with the conduit 87 and crankcase chamber 46, has a ball type check valve 94 that is normally urged into seating engagement by a light coil spring 95 so as to preclude any flow from the chamber 46 into the conduit 87. However, when the pressure in the conduit 87 is greater than the pressure in the chamber 46, the ball valve 94 will unseat and lubricant may flow to the component being lubricated. This condition normally exists when the associated piston 41 is moving upwardly to drain an intake charge into the chamber 46.

Thus, it should be readily apparent that the described system not only insures that there will be adequate lubrication of all components of the engine but also that the lubricant will be delivered to cylinders equally even though some tends to flow by gravity to the lowermost cylinders.

Figure 5:
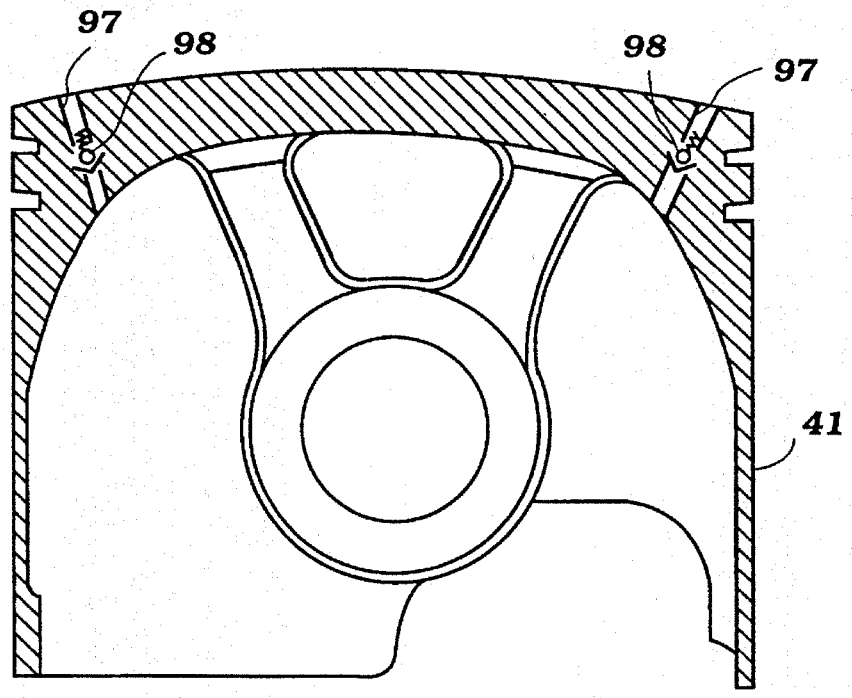
FIG. 5 is an enlarged cross-sectional view of the area encompassed by the phantom line circle 5 in FIG. 2 and shows one structure for lubricating the sliding surfaces of the piston and cylinder.

In addition to the system of lubrication as thus far described, an arrangement is also provided for permitting some flow from the individual crankcase chambers 46, 47, 48 and 49 to the cylinder bore associated directly therewith through the pistons 41. As seen in FIG. 5, a passageway 97 extends through the dome of the piston and has a check valve 98 positioned therein which will permit flow from the crankcase chamber through the piston to the respective cylinder bore but no flow in the opposite direction. Hence, the compression pressure in the cylinder will not be lost but when the piston is moving downwardly some lubricant may flow through passages 97 to lubricate the cylinder liners 39 and pistons 41. Preferably these passages 97 are disposed primarily toward the vertically topside of the pistons 41 although a plurality of passages may be employed.

Figure 6:
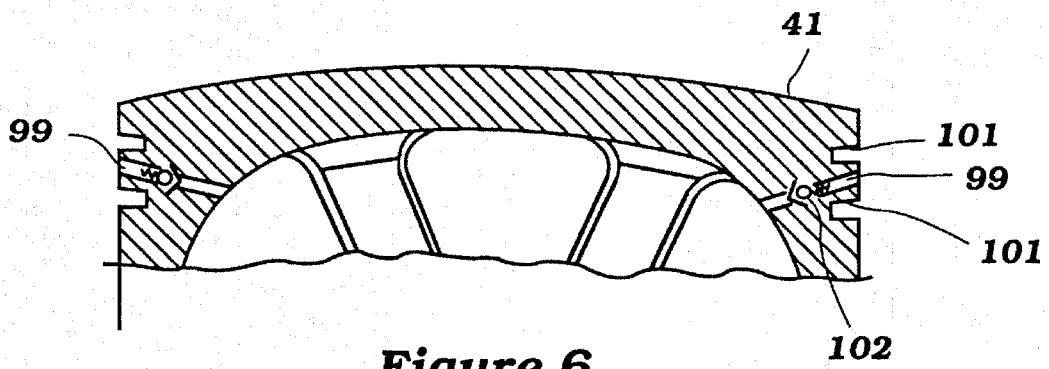
FIG. 6 is a partial cross-sectional view, in part similar to FIG. 5, and shows another embodiment of the invention.

FIG. 6 shows another embodiment for cylinder bore and piston lubricating wherein the passageways 99 are formed through the sides of pistons 41 in an area between ring grooves 101. Again, check valves 102 are provided in the passages 99 so as to permit lubricant to flow from the crankcase chamber to the cylinder liner 39 and piston 41 but to avoid loss of compression.

Figure 7:
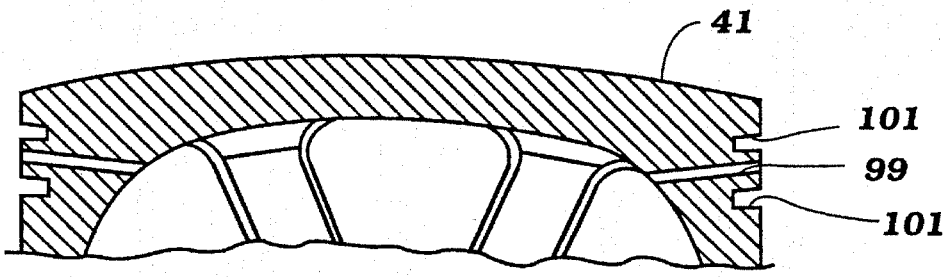
FIG. 7 is a cross-sectional view, in part similar to FIGS. 5 and 6, and shows yet another embodiment of the invention.

FIG. 7 shows still a further embodiment wherein the check valves 102 are eliminated as is possible because of the intersection between the piston ring grooves 101. As a result of this construction, it will be insured that lubricant can be delivered but no compression will be lost.

Figure 9:
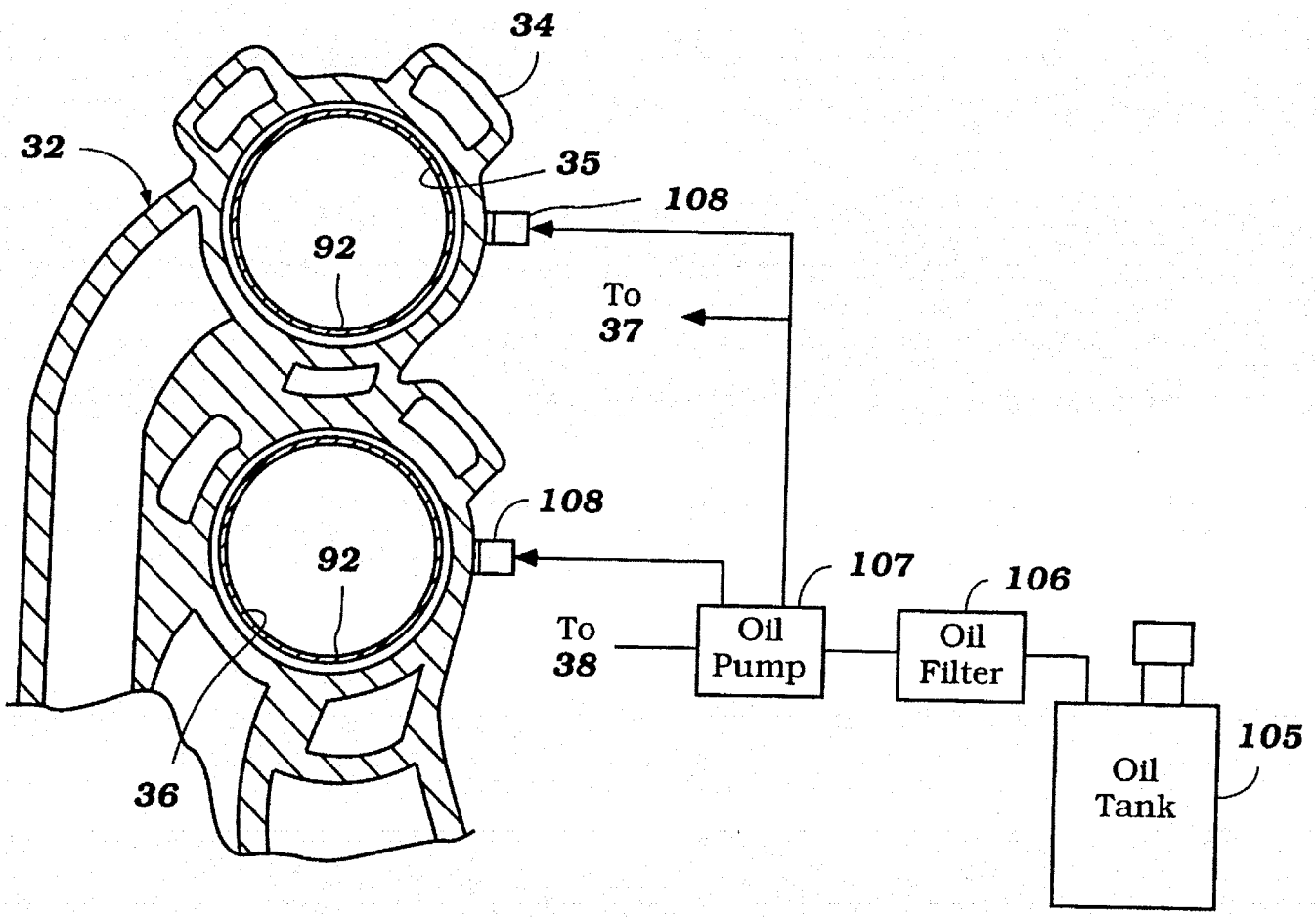
FIG. 9 is a partial cross-sectional view with portions shown schematically indicating one structure in which the lubricant may be delivered to the engine through a positive lubricating system.

As has been previously, lubricant may be supplied to the engine from an external oil supply in any manner and FIG. 9 shows one way in which this may be done by delivering lubricant directly to cylinder liners through the grooves 92 and passageways 93. As may be seen, the system has an external oil tank 105 which may be contained within the powerhead and which supplies oil through an oil filter 106 to an oil pump 107 that has discharge lines that lead to oiling inlet fittings 108 supplied for each cylinder bore 35, 36, 37 and 38 of the engine. This oil supply may be through the grooves 92 or through extra grooves provided solely for this purpose.

It should be readily apparent from the foregoing description that the described lubrication systems insure good and equal lubrication to all cylinders of the engine even though it is horizontally disposed and avoids uneven combustion or poor running as might result it too much lubricant were to accumulate in individual crankcase chambers of the engine. Of course, the foregoing description is that of preferred embodiments of the invention and various changes and modifications may be made without departing from the spirit and scope of the invention, as defined by the appended claims.

We claim:

1. A lubricating system for an internal combustion engine having at least two horizontally disposed cylinders, one disposed vertically above the other, each of said cylinders having a respective lubricated portion one disposed vertically above the other, means for delivering lubricant to said lubricated portions, means for draining lubricant from a lower area of the lower of said lubricated portions, and means for delivering the drained lubricant only to an upper area of the upper lubricated portion including a single uninterrupted flow conduit.

2. A lubricating system as set forth in claim 1 wherein the means for delivering the drained lubricant includes a conduit with check valve means therein for permitting flow only in one direction.

3. A lubricating system as set forth in claim 2 wherein the operation of the engine causes the pressure in one of the lubricated portions to vary cyclically.

4. A lubricating system as set forth in claim 3 wherein the check valve means permits flow only to the upper lubricated portion and precludes flow from the upper lubricated portion to the lower lubricated portion.

5. A lubricating system as set forth in claim 4 wherein the lubricated portions each comprise a piston and cylinder bore.

6. A lubricating system as set forth in claim 5 wherein the pressure in both lubricated portions varies cyclically but the cyclic variations are out of phase with each other.

7. A lubricating system as set forth in claim 1 wherein there are more than two cylinders and each cylinder below the top cylinder has its lubricated portion drained and the drained lubricant is delivered only to cylinders above the drained cylinder.

8. A lubricating system as set forth in claim 7 wherein each of the cylinders have crankcase chambers that are sealed from each other but are vertically positioned relative to each other so that leakage from one crankcase chamber will flow by gravity to the lower crankcase chambers.

9. A lubricating system as set forth in claim 8 wherein the engine is a two cycle crankcase compression engine.

10. A lubricating system as set forth in claim 9 wherein the lubricant drained from the lower cylinder is delivered to multiple locations in the upper cylinder.

11. A lubricating system as set forth in claim 10 wherein the means for delivering the drained lubricant includes a conduit with check valve means therein for permitting flow only in one direction.

12. A lubricating system as set forth in claim 11 wherein the operation of the engine causes the pressure in one of the lubricated portions to vary cyclically.

13. A lubricating system as set forth in claim 12 wherein the check valve means permits flow only to the upper lubricated portion and precludes from the upper lubricated portion to the lower lubricated portion.

14. A lubricating system as set forth in claim 8 wherein lubricant is delivered to an upper area of the cylinder bores.

15. A lubricating system as set forth in claim 14 wherein the lubricant is delivered to the cylinder bores through a passage formed in the cylinder.

16. A lubricating system as set forth in claim 14 wherein the lubricant is delivered to the cylinder bores through passages in the pistons.

17. A lubricating system as set forth in claim 16 wherein the passages are formed in the heads of the pistons.

18. A lubricating system as set forth in claim 17 further including check valve means in the passages for permitting flow only from the interior of the pistons to the heads of the pistons.

19. A lubricating system as set forth in claim 16 wherein the passages extends through the skirt of the pistons.

20. A lubricating system as set forth in claim 19 further including check valve means in the passages for permitting flow only from the interior of the pistons to the exterior of the pistons.

21. A lubricating system as set forth in claim 19 wherein the passages extends between a pair of ring grooves formed in the skirts of the pistons.

22. A lubricating system as set forth in claim 21 further including check valve means in the passages for permitting flow only from the interior of the pistons to the exterior of the pistons.

23. A lubricating system as set forth in claim 1, wherein each cylinder defines a horizontally extending cylinder bore, and further including a piston reciprocating in each cylinder bore and sweeping a portion of the length of the respective cylinder bore, a circumferential groove formed in a surface of each cylinder spaced radially outwardly of its respective cylinder bore and along the upper side of said cylinder bore, the means for delivering lubricant comprising at least one passage extending through said cylinder from said circumferential groove at a point above the lower periphery of said cylinder bore and adjacent the uppermost surface of said piston and means for introducing lubricant to said circumferential groove.

24. A two cycle internal combustion engine having a cylinder defining a cylinder bore, a piston reciprocating in said cylinder bore and sweeping a portion of the length of said cylinder bore, a passage extending through said piston for introducing lubricant into the swept area of said cylinder bore, and check valve means in said passage for permitting flow only from the interior of the piston to the exterior surface of said piston.

25. A two cycle internal combustion engine as set forth in claim 24 wherein the passage is formed in the head of the piston.

26. A two cycle internal combustion engine as set forth in claim 24 wherein the passage extends through the skirt of the piston.

27. A two cycle internal combustion engine as set forth in claim 26 wherein the passage extends between a pair of ring grooves formed in the skirt of the piston.

28. A two cycle internal combustion engine as set forth in claim 24 wherein the lubricant introduced to the cylinder bore is drained from another portion of the engine.

29. A two cycle internal combustion engine as set forth in claim 28 wherein the other portion is positioned vertically beneath the point where the lubricant is introduced to the cylinder bore.

30. A two cycle internal combustion engine as set forth in claim 29 wherein the lubricant is drained from another piston cylinder bore assembly.

31. A two cycle internal combustion engine as set forth in claim 30 wherein the other cylinder piston assembly has a crankcase and the lubricant is drained from the crankcase of the other piston cylinder assembly.

32. A two cycle internal combustion engine as set forth in claim 24 further including pumping means for pumping the lubricant to the cylinder bore.

* * * * *